US006345920B1

(12) United States Patent
Enoksson et al.

(10) Patent No.: US 6,345,920 B1
(45) Date of Patent: Feb. 12, 2002

(54) METHOD OF ENERGY CONTROL IN PRINTING WITH TRANSFER RIBBON AND DIRECT THERMO MATERIAL IN THERMO-PRINTERS

(75) Inventors: Hans Enoksson, Molndal; Hakan Berglund, Lerum; Anders Akesson, Frolunda, all of (SE)

(73) Assignee: Intermec IP Corp., Woodland Hills, CA (US)

( * ) Notice: Subject to any disclaimer, the term of this patent is extended or adjusted under 35 U.S.C. 154(b) by 0 days.

(21) Appl. No.: 09/485,781

(22) PCT Filed: Jul. 24, 1998

(86) PCT No.: PCT/SE98/01410

§ 371 Date: May 8, 2000

§ 102(e) Date: May 8, 2000

(87) PCT Pub. No.: WO99/08877

PCT Pub. Date: Feb. 25, 1999

(30) Foreign Application Priority Data

Aug. 14, 1997 (SE) ..... 9702933-4

(51) Int. Cl.[7] ..... B41J 2/35

(52) U.S. Cl. ..... 400/120.12; 400/120.09; 400/120.13; 347/188; 347/192; 347/193

(58) Field of Search ..... 400/120.01, 120.09, 400/120.13, 120.11, 120.07, 120.08, 120.1, 120.12, 120.15; 347/189, 190, 191, 192, 183, 193, 194, 188, 196, 195, 209, 210

(56) References Cited

U.S. PATENT DOCUMENTS

| | | | | | |
|---|---|---|---|---|---|
| 5,310,272 | A | * | 5/1994 | Nishizawa | 400/279 |
| 5,432,533 | A | | 7/1995 | Shibamiya | 347/192 |
| 5,482,386 | A | * | 1/1996 | Thiel et al. | 400/120.12 |
| 5,517,229 | A | * | 5/1996 | Gunther | 347/211 |
| 5,623,297 | A | | 4/1997 | Austin et al. | 347/194 |
| 5,625,399 | A | | 4/1997 | Wiklof et al. | 347/195 |
| 5,625,401 | A | | 4/1997 | Wiklof et al. | 347/208 |
| 5,689,297 | A | | 11/1997 | Yokoyama et al. | 347/188 |
| 5,816,719 | A | * | 10/1998 | Palmer | 400/120.01 |
| 6,025,861 | A | | 2/2000 | Austin et al. | 347/211 |

* cited by examiner

*Primary Examiner*—John S. Hilten
*Assistant Examiner*—Kevin D. Williams
(74) *Attorney, Agent, or Firm*—Orum & Roth

(57) ABSTRACT

The invention relates to a method for controlling the amount of energy from a printer head in a thermo-printer. The appropriate amount of energy for obtaining the best possible print quality with a certain printing material is controlled through calculating the amount of energy required as a function of the printing speed of the printer, over the full range of printer speed, and of the characteristic printing material data. The printing speed is continuously variable within the complete printing speed range of the printer. Characteristic data for the printing material are classified for magnitude and may be given as an offset relative to a reference material, or as absolute values.

4 Claims, 1 Drawing Sheet

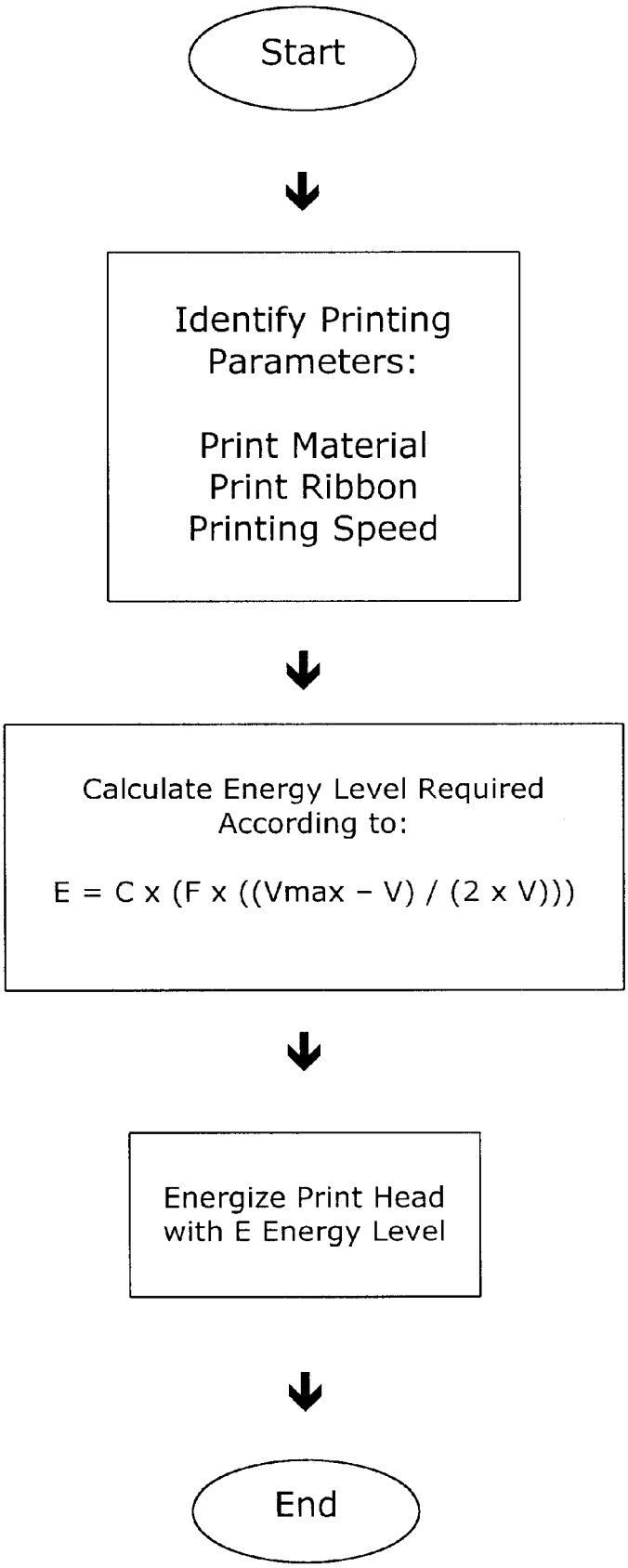
Start
Identify Printing Parameters:
Print Material
Print Ribbon
Printing Speed
Calculate Energy Level Required According to:
E = C x (F x ((Vmax − V) / (2 x V)))
Energize Print Head with E Energy Level
End

METHOD OF ENERGY CONTROL IN PRINTING WITH TRANSFER RIBBON AND DIRECT THERMO MATERIAL IN THERMO-PRINTERS

BACKGROUND OF THE INVENTION

The transfer of ink from a transfer ribbon to the receiving material, e.g. a paper label, and the colouring of direct thermo material is controlled by variable amounts of thermal energy. Depending on how sensitive the transfer ribbon or the direct thermo material is for these amounts of energy, and on what printing speed is used, more or less energy is required to obtain the desired print quality and result in the form of a printed image.

SUMMARY OF THE INVENTION

The object of the present invention is to achieve the highest possible print quality on an arbitrary printing material by utilizing an appropriate amount of energy at an optional printing speed.

This object is accomplished by the method according to the following description.

DESCRIPTION OF THE DRAWINGS

The FIGURE is a block diagram of a method of the invention.

DETAILED DESCRIPTION

The present invention relates to a method for controlling the amount of energy that is emitted from the thermo head of a thermo-printer in order to obtain the desired ink transfer or colouring. The amount of energy can be described as a function of printing speed and characteristic printing material data according to the following formula or control algorithm:

$$E=f(\text{printing speed, characteristic printing material data})\text{ for example}$$

$$E=C+(F\times((300-v)/(2\times v))),$$

where E is the amount of energy, v is the printing speed and C and F are a Constant and a Factor, respectively, characteristic of the printing material. The maximum printing speed for which the function is valid is 300 mm/s in this example, but the speed can be increased by modifications to the function. C as well as F may be multiplied by further factors in order to give the curve a different slope within the speed interval in question. Furthermore, the amount of energy depends on the mechanical pressure applied by the thermo head on the transfer ribbon/receiving material or the direct thermo material, but the pressure may be considered to be the same for the same type of printers. Other properties affecting the ink transfer or colouring may be the surface chemistry etc. of the materials, but such properties may be regarded as being the same for the same type of materials.

The energy of each individual dot in the thermo head can furthermore be described by how this dot has been used in the past, how adjacent dots are used and how the dots in front will be used, and by the resistance and the temperature of the thermo head. However, this historical difference in the energy amount follows a constant reciprocal function that is independent of the printing speed.

An appropriate formula (control algorithm) is stored in the printer software, and this algorithm is subsequently used for calculating the appropriate energy amount for each combination of transfer ribbon/receiving material or direct thermo material, and printing speed.

When determining the appropriate amount of energy for several transfer ribbons onto one and the same receiving material, it has been found that the offset energy (positive or negative) required when printing on a different receiving material will be the same for all transfer ribbons or classes of transfer ribbons (wax, wax/resin, resin). Similarly, the same formula can be used for direct thermo materials with similar thermal sensitivity.

The criteria used when determining the appropriate amount of energy may e.g. be the print's optical density, bar code quality according to ANSI/CEN, or widening of the bars of a bar code.

The advantages of the method of the present invention are as follows:

One printer setting will work over the entire speed range of the printer. The physical limits of the materials regarding printing speed must however be considered.

Simple switching between different combinations of transfer ribbons/receiving materials or direct thermo materials.

Possibilities of adjusting the print quality to the requirements of the user.

Possibilities for systematic marking of transfer ribbons, receiving materials and label materials that will allow easy and simple optimum setting of the printer, for the materials in question, by the user. Furthermore, it will be simple to widen the assortment of transfer ribbons and materials with new qualities, with information about the optimum printer setting.

What is claimed is:

1. Method for controlling a printer head in a thermo-printer comprising the steps of:

identifying a print material, print ribbon and printing speed; calculating an amount of energy required by the print head according to:

$$E=C\times(F\times((V\max-V)/(2\times V)))$$

where:

E=Energy level required

C=a constant, characteristic of the printing material

F=a factor, characteristic of the printing material

Vmax=the maximum printing speed of the printer

V=the current printing speed of the printer;

energizing the print head with the calculated amount of energy required.

2. The method of claim 1 further including a factor representing a level of mechanical pressure between the print head and the print material in the calculation of the amount of energy required.

3. The method of claim 1 further including a constant representing recent activation of individual dots of the print head desired to be activated in the calculation of the amount of energy required.

4. The method of claim 3 further including a constant representing recent activation of individual dots adjacent to individual dots of the print head desired to be activated in the calculation of the amount of energy required.

* * * * *